US005730375A

United States Patent [19]

Cranfill et al.

[11] Patent Number: 5,730,375

[45] Date of Patent: Mar. 24, 1998

[54] BLADE ASSEMBLY AND METHOD

[75] Inventors: Timothy W. Cranfill, 788 Beauchamp Rd., Advance, N.C. 27006; Steven B. Vick, Mocksville, N.C.

[73] Assignee: Timothy W. Cranfill, Advance, N.C.

[21] Appl. No.: 749,539

[22] Filed: Nov. 15, 1996

[51] Int. Cl.[6] ..... B02C 18/08

[52] U.S. Cl. ..... 241/243; 144/218; 144/230; 144/172; 144/241; 241/291; 241/292.1; 407/48; 29/26 A; 29/428

[58] Field of Search ..... 407/40, 46, 47, 407/48; 144/218, 230, 162.1, 172, 174, 241; 241/236, 227, 242, 243, 292.1, 294; 29/26 R, 26 A, 428, 432

[56] References Cited

U.S. PATENT DOCUMENTS

| | | | |
|---|---|---|---|
| 4,000,860 | 1/1977 | Gotham . | |
| 4,176,800 | 12/1979 | Brewer . | |
| 4,213,572 | 7/1980 | Pallmann . | |
| 4,350,308 | 9/1982 | Brewer . | |
| 4,470,723 | 9/1984 | Lindsay | 407/48 |
| 4,506,715 | 3/1985 | Blackwell | 407/48 |
| 4,770,219 | 9/1988 | Blackwell, Jr. | 407/48 |
| 4,819,703 | 4/1989 | Rice et al. . | |
| 5,211,212 | 5/1993 | Carlson et al. | 407/48 |
| 5,348,064 | 9/1994 | Nettles et al. . | |

*Primary Examiner*—W. Donald Bray

[57] ABSTRACT

A blade assembly for a shredding machine is presented which can be used in the method for replacing broken blades and when rebuilding the blade seat. The method includes milling the base support to reduce its height and redrilling the blade bolt holes. A new independent blade seat is then affixed by double-threaded bushings after which a new blade can then be bolted atop the blade seat.

19 Claims, 4 Drawing Sheets

BLADE ASSEMBLY AND METHOD

BACKGROUND OF THE INVENTION

1. Field Of The Invention

The invention herein pertains to a blade assembly and particularly to a blade assembly as used on rotor shafts for industrial equipment such as tire shredding machines.

2. Description Of The Prior Art And Objectives Of The Invention

Tire shredding equipment has increased in use in recent years to alleviate landfill shortages of municipalities and others. Such tire shredding machines rip used vehicle tires into small pieces which can then be further processed as needed to be more easily disposed or recycled. While such equipment is usually well-constructed for its intended purpose, oftentimes foreign matter such as scrap metal or broken blades inadvertently fall into the shredding machine. Such scrap metal can cause havoc to the rotor assemblies, oftentimes causing undue wear and/or breaking of the blades and blade supports. Also, worn blades must be continually inspected and replaced with as little downtime as possible due to both the high labor costs of replacing worn or broken blades and the high overhead expense for idle shredding equipment.

A typical tire shredding operation may utilize one or more shredding machines such as a Columbus-McKinnon CM which utilizes two opposing rotor assemblies. Each rotor assembly provides eleven rows, with fourteen blades circumferentially disposed on each row. Should but one of the three-hundred and eight blades fracture and break loose, the loose blade fragment will impact other blades, setting forth a chain of events, causing major damage possibly causing the tire shredding machine to be shut down for an extended period until proper maintenance and repairs can be completed. Thus, costly routine maintenance is essential to identify cracked or severely worn blades for replacement before greater problems and longer down-time and extensive repairs are required.

While the replacement of a single worn blade is, of itself, hardly a difficult problem, damage to the blade support which holds the blade is of greater concern. The blade support generally extends from the rotor shaft a few inches and the top thereof forms the seat for the blade as shown in FIG. 9 herein. If the blade support seat surface becomes marred, chipped or cracked, then the blade cannot be properly attached and the blade support itself must be reformed before a replacement blade can be attached. Reforming a blade support requires resurfacing of the top or seat of the blade support and usually welding the seat and face or front of the blade support to repair any chips or cracks. Thereafter using a jigged mill, the face, sides, edges and top are shaped as needed and tie bar grooves are recut into the top of the blade support for reception of tie rods for holding the side plates. Next, the blade support is drilled and tapped for threaded inserts which are urged into the tapped holes. Next, threaded bushings are hammered into the tapped holes atop the inserts for receiving the blade bolts. Finally, a new blade having new bolts is attached along with the accompanying tie rods and side plates.

Not only does this conventional maintenance and repair process take an inordinate amount of time, the mechanic must be skilled and experienced in order to accurately perform the task, since an improperly rebuilt blade support will have to be redone, creating additional down time and labor expenses.

Thus, with the problems, expenses and inconvenience of conventional blade replacement, assemblies, maintenance and methods, the present invention was conceived and one of its objectives is to provide a blade assembly and method which will greatly simplify replacement and maintenance procedures on rotor assemblies.

It is still another objective of the present invention to provide a blade assembly having a ready-made independent blade seat and double-threadedbushing for use in blade replacement procedures.

It is also an objective of the present invention to provide a blade replacement method which can quickly be learned and accurately performed by relatively unskilled mechanics.

It is a further objective of the present invention to provide a blade replacement method which reduces down-time and operating costs during shredding machine maintenance and repairs.

Various other objectives and advantages of the present invention will become apparent to those skilled in the art as a more detailed description is set forth below.

SUMMARY OF THE INVENTION

The aforesaid and other objectives are realized by providing an independent blade seat which can be used in the method of replacing worn or broken rotor blades as are used on tire shredding equipment. The independent blade seat is affixed to the blade support which has been drilled and tapped for reception of double-threaded bushings which secure the seat thereon after the old blade is removed and the blade support is rebuilt by welding and milling. A new blade can then be bolted to the blade seat through the double-threaded bushings previously installed. The new blade assembly can be in operation in a relatively short period of time and if the replacement blade wears or breaks, it can be more easily replaced, along with the blade seat if necessary.

DETAILED DESCRIPTION OF THE PREFERRED EMBODIMENTS

Figure 1:
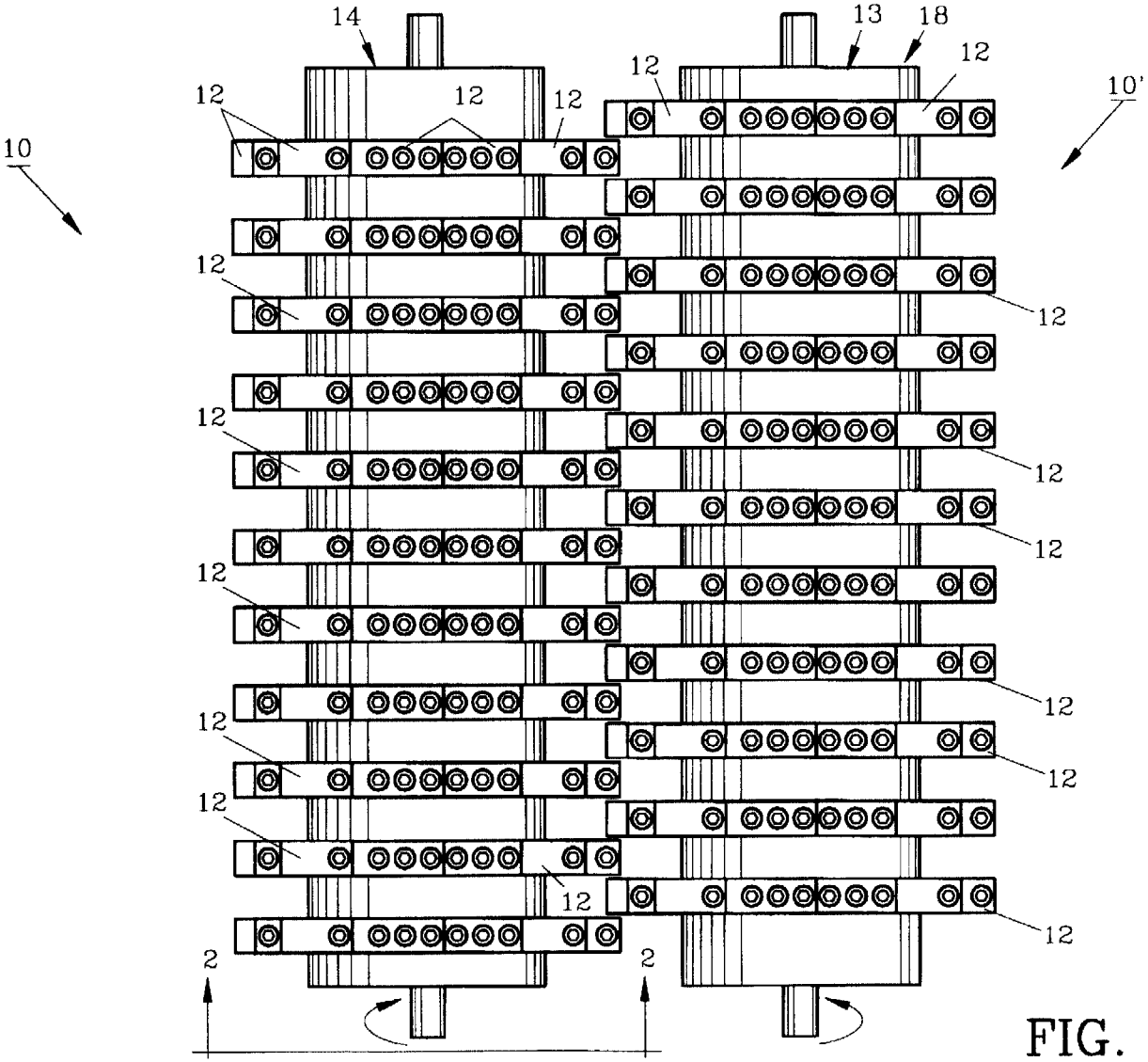
FIG. 1 illustrates a top view of a pair of opposing rotor assemblies as positioned in a conventional tire shredding machine.
Figure 2:
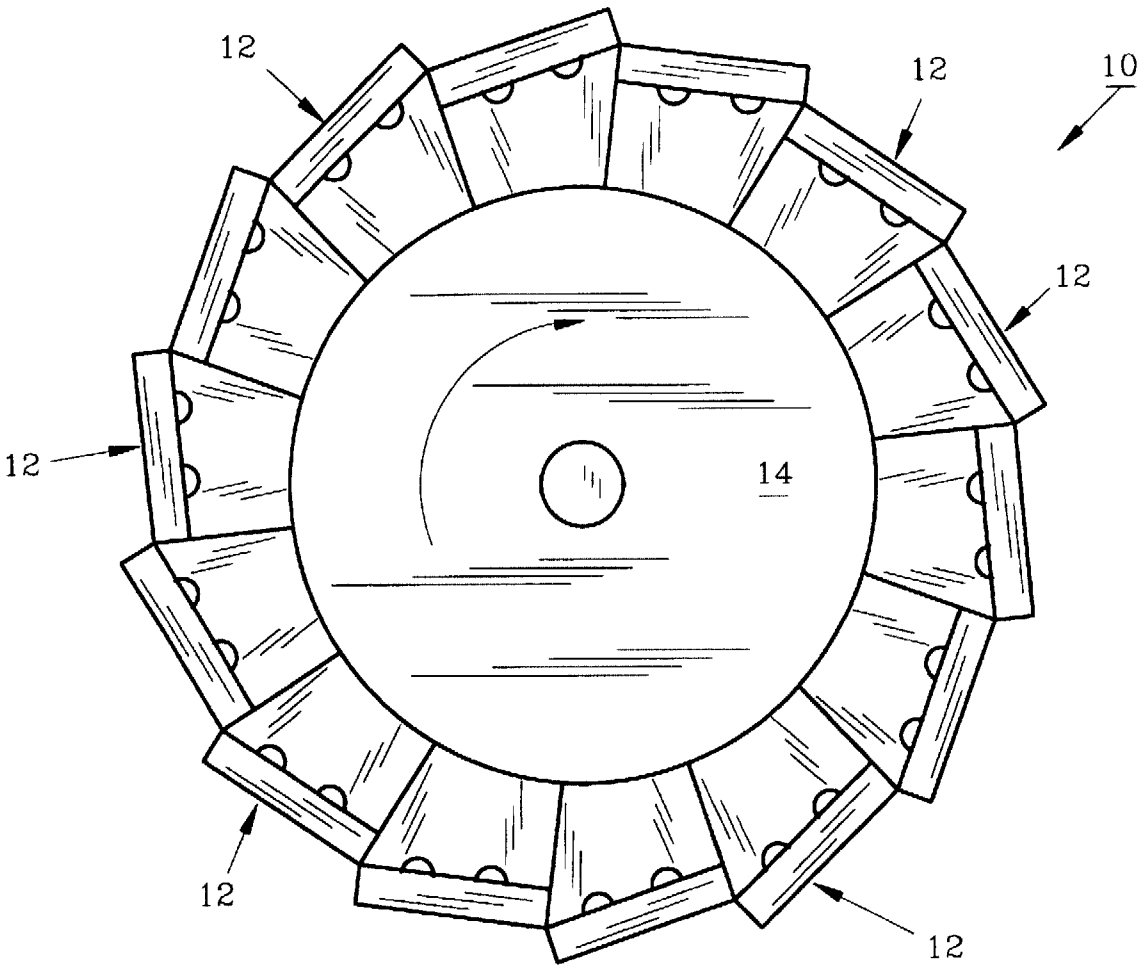
FIG. 2 demonstrates a side view of one of the rotor assembly along lines 2—2 as shown in FIG. 1.
Figure 9:
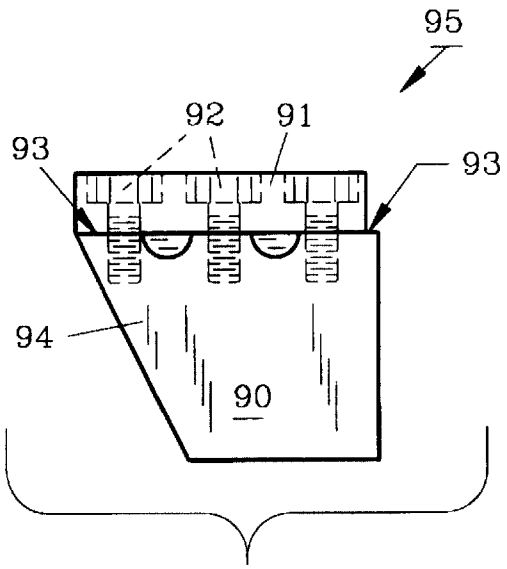
PRIOR ART FIG. 9
FIG. 9 pictures a conventional blade assembly as now used in the art.
Figure 4:
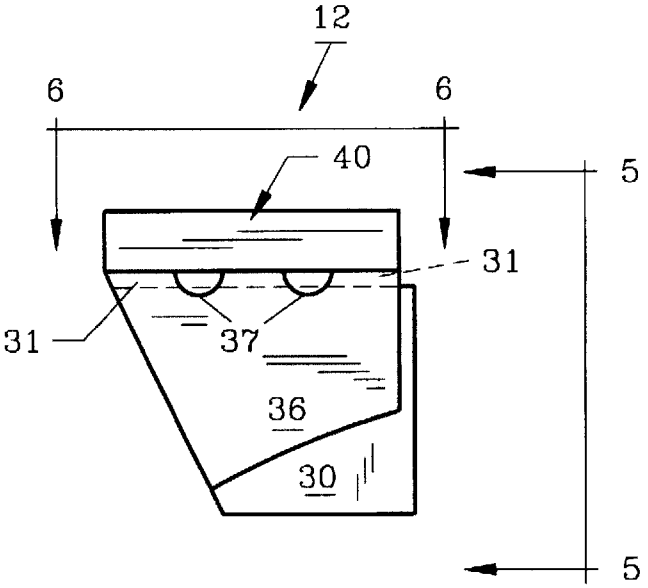
FIG. 4 shows an assembled side view of the blade assembly as seen in FIG. 3.

For a better understanding of the invention, turning now to the drawings, FIG. 1 shows a top view of a pair of rotor assemblies 10, 10' as are conventionally mounted in standard shredding equipment used for shredding used vehicle tires. As seen, rotor assembly 10 turns in a clockwise direction whereas rotor assembly 10' turns in a counterclockwise direction with blade assemblies 12 slightly overlapping therebetween. Rotor shafts 13 of rotor assembly 10' and rotor shaft 14 of rotor assembly 10 each contain eleven (11) rows of blade assemblies 12 with each row having fourteen blade assemblies 12 positioned circumferentially thereon as better seen in FIG. 2. A typical tire shredding machine utilizing opposing rotor assemblies is a "CM" shredder as sold by Columbus-McKinnon of Sarasota, Fla. In such a typical shredding machine, blade assembly 95 as seen in FIG. 9 consists of a blade support 90 to which a blade 91 is bolted by three bolts 92. After a period of use, blade 91 will wear and/or break, thereby requiring the mechanic to replace blade 91. However, in a usual tire shredding operation, blades 91 frequently break and are not immediately replaced causing blade seat 93, which is the top surface of blade support 92, to become worn and often chipped or fragmented. Also, bolts 92 can become bent or broken, oftentimes requiring redrilling and retapping of plate support 90, so larger replacement bolts can be threadably received. The rebuilding of seat 93 often requires weldments and milling for proper resurfacing. This resurfacing of can be extremely time-consuming and costly both for the mechanic's time and due to the down-time of the shredding machine. Thus, the invention herein provides a method for greatly reducing the time of blade replacement and saves the operator expenses.

Figure 7:
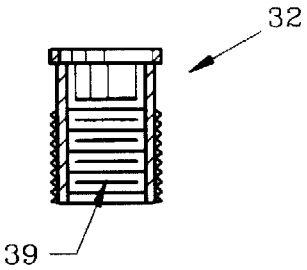
FIG. 7 depicts an enlarged cross-sectional view of the double-threaded bushing as seen in FIG. 3.
Figure 5:
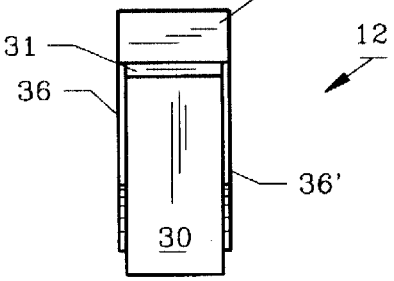
FIG. 5 demonstrates the rear of the blade assembly as seen in FIG. 4 along lines 5—5.
Figure 3:
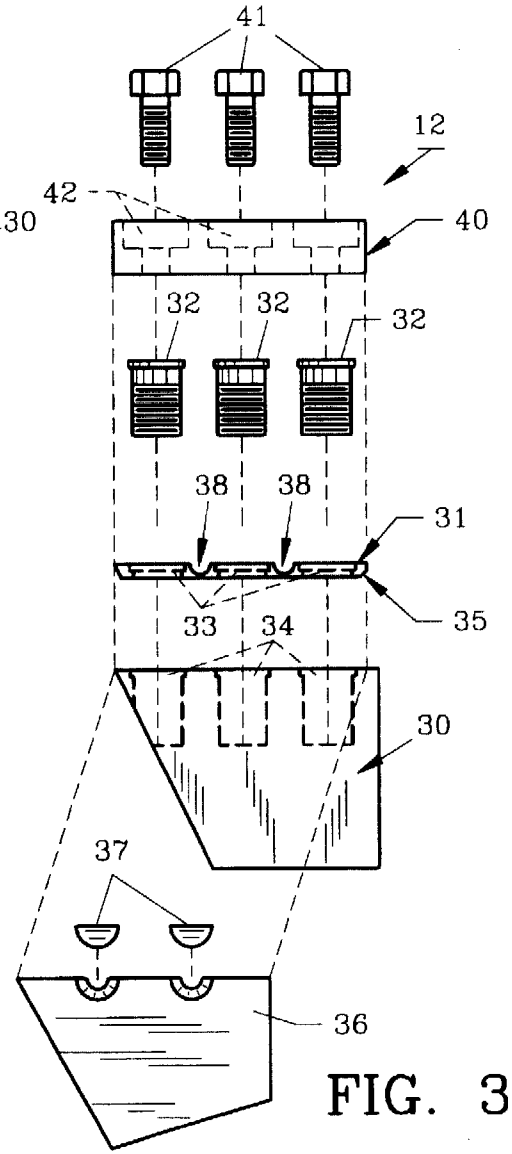
FIG. 3 depicts an exploded view of the preferred embodiment of the blade assembly of the invention as removed from the rotor shaft.
Figure 6:
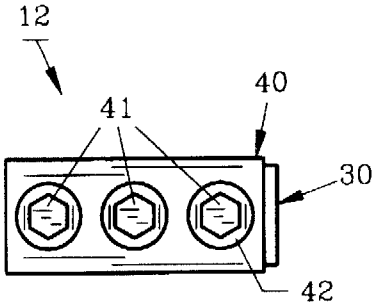
FIG. 6 provides a top view of the blade assembly shown along lines 6—6 in FIG. 4.
Figure 8:
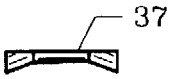
FIG. 8 illustrates a side view of one of the tie bars as shown in FIG. 3.

The preferred method of blade replacement includes removing the old blade by withdrawing bolts 92 such as shown in FIG. 9, to allow blade 91, which may be worn and chipped, to be removed and discarded. Next, a standard milling machine is positioned on blade support 90 after side plates 36, 36' (seen in FIG. 5) are removed along with tie bars 37, and in the preferred embodiment, 0.25 inches (64 mm) height is removed from the top to form blade support 30. Next, bushing wells 34 are drilled and tapped and blade seat 31 of 0.64 mm height is then positioned atop milled blade support 30 as shown in FIG. 3. In the preferred embodiment of the present invention, seen in FIG. 3 blade seat 31 is held in place by double-threaded bushings 32 which are passed through blade seat bushing wells 33 where they are threadably affixed within blade support bushing wells 34, also shown in FIG. 3. Blade seat 31 is slightly chamfered at rear edge 35 (FIG. 3) for ease of installation. Next, conventional blade support side plates 36, 36' are placed against the sides of blade support 30 and are held in place by standard tie rods 37, also shown in FIG. 3. Tie rods 37 flushly fit within blade support grooves 38 to retain side plates 36, 36' against blade support 30 during assembly. Tie rod 37 is seen in a side view in FIG. 8. Next, conventional blade 40 is positioned atop blade seat 31 which has bushings 32 flushly positioned therein. Next, bolts 41 are tightened through bolt apertures 42 (FIG. 6) into bushings 32 which threadably receive bolts 41 interiorly thereof. In FIG. 7, bushing 32 shows interior threaded channel 39 (seen in cross-section). Once bolts 41 have been properly torqued, blade assembly 12 is again ready for use with bolts 41 flushly positioned within blade 40.

After extended use, blade 40, as shown in FIG. 3, will again wear and by simply removing bolts 41, blade 40 can be replaced. In the event wear or damage occurs to blade seat 31, it likewise can be removed and replaced simply by removing plate seat bushings 32 generally without the milling and resurfacing needed as hereinbefore described for conventional blade support 95, thus saving the operator expensive labor and down-time costs.

The illustrations and examples provided herein are for explanatory purposes and are not intended to limit the scope of the appended claims.

I claim:

1. A blade assembly for a rotor shaft comprising: a blade support, said support affixed to said rotor shaft, a removable blade seat, said removable blade seat defining a plurality of openings, said removable blade seat releasably affixed to the top of said blade support, and a blade, said blade releasably attached to said blade seat.

2. The blade assembly of claim 1 further comprising a pair of side plates, said side blades fastened to said blade support.

3. The blade assembly of claim 1 further comprising a double-threaded blade seat bushing, said double-threaded blade seat bushing threadably attached to said blade support for affixing said blade seat thereto.

4. The blade assembly of claim 3 further comprising a blade bolt, said blade bolt threadably received within said double-threaded blade seat bushing for releasable attachment of said blade.

5. The blade assembly of claim 2 further comprising a tie rod, said tie rod for attaching said side plate to said blade support.

6. The blade assembly of claim 5 wherein said blade seat defines a groove, said groove for flush reception of said tie rod.

7. The blade assembly of claim 4 wherein said double-threaded blade seat bushing defines an interior threaded channel, said interior channel for reception of said blade bolt.

8. The blade assembly of claim 1 wherein said blade seat has a generally rectangular cross-section.

9. The blade assembly of claim 1 wherein said blade seat has a chamfered rear edge, said chamfered rear edge contiguous to said blade support.

10. A blade assembly for a rotor shaft used for shredding comprising: a blade support, said support mounted on said rotor shaft, said blade support defining a bushing well, a blade seat, said blade seat defining a bushing well, a blade seat bushing, said blade seat bushing defining an interior threaded channel, said blade seat bushing positioned within said blade seat bushing well and within said blade support bushing well to affix said blade seat to said blade support, a blade, said blade defining a bolt aperture, a bolt, said bolt positioned within said aperture for affixing said blade to said blade seat.

11. The blade assembly of claim 10 wherein said blade seat bushing is exteriorly threaded.

12. The blade assembly of claim 10 wherein said bolt is threadably received within said blade seat bushing interior threaded channel.

13. The blade assembly of claim 10 further comprising a pair of blade support side plates, a tie rod, said tie rod for attaching said side plates to opposite side of said blade support.

14. The blade assembly of claim 13 wherein said blade seat defines a tie rod groove, said groove for reception of said tie rod.

15. A method of replacing a blade on a blade support of a rotor assembly comprising the steps of:

a. removing the old blade, b. attaching an independent blade seat to the blade support, c. drilling the blade support to accommodate a double threaded blade seat bushing; and d. attaching a new blade atop the blade seat.

16. The method of claim 15 further comprising the step of milling the top of the blade support.

17. The method of claim 15 further comprising the step of inserting a double threaded blade seat bushing into the blade support.

18. The method of claim 16 wherein milling the top of the blade support comprises milling the blade support for reception of said blade seat.

19. A method for forming a replaceable blade assembly for a rotor shaft, wherein the blade assembly includes a blade support mounted on the rotor shaft, a blade seat, and a double threaded bushing, said method comprising the steps of:

a) providing a bushing well within the blade support;

b) providing a bushing well within the blade seat; and c) threading the double threaded bushing through the blade seat bushing well and into the blade support bushing well to affix the blade seat to the blade support.

* * * * *